US006862424B2

(12) United States Patent
Matsunaka et al.

(10) Patent No.: US 6,862,424 B2
(45) Date of Patent: Mar. 1, 2005

(54) IMAGE HEATING APPARATUS

(75) Inventors: Katsuhisa Matsunaka, Numazu (JP); Masaaki Takahashi, Odawara (JP); Osamu Soutome, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/315,037

(22) Filed: Dec. 10, 2002

(65) Prior Publication Data

US 2003/0138263 A1 Jul. 24, 2003

(30) Foreign Application Priority Data

Dec. 10, 2001 (JP) ..... 2001-375480
Dec. 2, 2002 (JP) ..... 2002-349750

(51) Int. Cl.[7] ..... G03G 15/20
(52) U.S. Cl. ..... 399/333; 399/69
(58) Field of Search ..... 399/67, 69, 70, 399/328, 329, 330, 333; 219/216

(56) References Cited

U.S. PATENT DOCUMENTS

| | | | | |
|---|---|---|---|---|
| 5,083,168 A | | 1/1992 | Kusaka et al. | |
| 5,162,634 A | | 11/1992 | Kusaka et al. | 219/216 |
| 5,210,579 A | | 5/1993 | Setoriyama et al. | |
| 5,262,834 A | | 11/1993 | Kusaka et al. | |
| 5,525,775 A | | 6/1996 | Setoriyama et al. | 219/216 |
| 5,538,677 A | | 7/1996 | Takahashi | 264/221 |
| 5,608,508 A | | 3/1997 | Kumagai et al. | 399/339 |
| 5,717,988 A | | 2/1998 | Jinzai et al. | 399/333 |
| 5,745,833 A | * | 4/1998 | Abe et al. | 399/330 |
| 5,753,348 A | | 5/1998 | Hatakeyama et al. | 428/195 |
| 5,778,294 A | * | 7/1998 | Hiraoka et al. | 399/329 |
| 5,862,445 A | * | 1/1999 | Ogawa et al. | 399/329 |
| 5,966,578 A | | 10/1999 | Soutome et al. | 399/333 |
| 5,970,299 A | * | 10/1999 | Sano et al. | 399/330 |
| 6,377,777 B1 | | 4/2002 | Kishino et al. | 399/329 |
| 6,424,815 B1 | | 7/2002 | Kawamoto et al. | 399/325 |
| 6,459,878 B1 | | 10/2002 | Tomoyuki et al. | 399/331 |
| 6,501,935 B2 | * | 12/2002 | Hirai et al. | 399/329 |
| 6,505,016 B2 | * | 1/2003 | Tomita | 399/67 |
| 6,623,897 B2 | * | 9/2003 | Tomita | 399/328 X |
| 2002/0028736 A1 | | 3/2002 | Kishino et al. | 492/50 |
| 2002/0127035 A1 | | 9/2002 | Otsuka et al. | 399/329 |

FOREIGN PATENT DOCUMENTS

| | | | |
|---|---|---|---|
| JP | 2-157878 | | 6/1990 |
| JP | 4-44075 | | 2/1992 |
| JP | 4-204980 | | 7/1992 |
| JP | 10-10893 | | 1/1998 |
| JP | 2001-194943 | * | 7/2001 |

* cited by examiner

*Primary Examiner*—Sandra Brase
(74) *Attorney, Agent, or Firm*—Fitzpatrick, Cella, Harper & Scinto

(57) ABSTRACT

An image heating apparatus includes a heater: a rotatable member movable while being in contact with contact, the rotatable member including a metal layer and an elastic layer: a pressing member cooperative with the heater to form a nip for nipping and feeding a recording material; wherein the metal layer has a thickness which is not less than 10 $\mu$m and not more than 60 $\mu$m, and wherein a pressure per unit length with respect to a longitudinal direction of the nip is not less than 0.39N/mm and not more than 0.98N/mm.

8 Claims, 2 Drawing Sheets

IMAGE HEATING APPARATUS

FIELD OF THE INVENTION AND RELATED ART

The present invention relates to an image heating apparatus suitable as a thermal heating apparatus mounted in a copying machine, a printer, etc. In particular, it relates to an image heating apparatus which comprises a rotational member, such as a piece of film (or belt), with a low thermal capacity, and which heats an image through the rotational member.

In recent years, demand has been increasing for a copying machine, a printer, etc., which is smaller in power consumption and also, is shorter in startup time. One of the essential factors which substantially affects power consumption and startup time is a heating apparatus. Thus, there has been a technical trend to reduce the thermal capacity of a thermal fixing apparatus to reduce the power consumption of a thermal fixing apparatus while reducing the startup time of a thermal fixing apparatus.

Disclosed in Japanese Laid-open Patent Applications 2-157878, 4-44075, 4-204980, etc., are examples of such a fixing apparatus with a low thermal capacity, which comprises a ceramic heater having a heat generating resistor, a fixing belt rotationally driven in contact with the ceramic heater, a pressure roller pressed against the ceramic heater, with the interposition of the fixing belt, to form a nipping portion, and in which a recording medium bearing an unfixed image is put through the nipping portion formed between the fixing belt and pressure roller in order to thermally fix the unfixed image.

Heretofore, such a fixing apparatus with a low thermal capacity has been used essentially for the formation of a monochromatic image. Recently, however, it has been considered as a fixing apparatus for a full-color image forming apparatus.

A full-color image is a combination of three or four layered toner images different in color. Thus, in order to satisfactorily fix a full-color image, it is necessary to heat the plurality of layered toner images, in such a manner that the toner particles of an unfixed toner image are enveloped by the fixing belt.

However, a fixing belt for the fixation of a monochromatic image comprises only a substrate layer formed of a resinous substance such as polyimide, and a releasing layer, that is, the surface layer, formed of a resinous substance such as fluorinated resin. Therefore, it is relatively high in surface hardness, creating a few problems. For example, toner particles are crushed by the rigid surface layer, which results in image resolution reduction, or insufficient toner particle mixture.

As for the means for solving these problems, there is the method proposed in Japanese Laid-open Patent Application 10-10893, which employs a fixing belt in which an elastic layer is provided between the substrate layer and surface layer.

However, the presence of the elastic layer makes this type of fixing belt lower in thermal conductivity than a fixing belt for a monochromatic image which does not have the elastic layer. Generally, the temperature of the heater of a thermal fixing apparatus, such as the aforementioned fixing apparatus with a low thermal capacity, is kept constant at a predetermined level (fixing temperature) by controlling the power supply to the heater. Thus, if the fixing belt of such a fixing apparatus is low in thermal conductivity the beater temperature reaches the fixing temperature before the surface temperature of the bell reaches the fixing temperature. As a result, the heat generation of the heater is regulated (power supply to beater is regulated) before the surface temperature of the heater temperature reaches the fixing temperature. In order to enable an image forming apparatus to quickly start up from the standby state in which the image forming apparatus is waiting for the inputting of a print signal, it is necessary to supply the heater with a sufficient amount of power. However, if the belt is low in thermal conductivity, the power supply to the heater is regulated as described above, making it impossible for the image forming apparatus to quickly start up.

An elastic layer formed of heat resistant elastomer or the like is smaller in thermal conductivity than a substrate layer. Therefore, if a large amount of electric power is supplied to the heating member of a fixing apparatus employing an elastic belt in which such an elastic layer is layered on the substrate layer, the heat from the heater escapes, by a substantial amount, into members supporting the belt, before the surface temperature of the belt reaches a predetermined level. In other words, a fixing apparatus employing such a fixing belt is inferior in terms of thermal efficiency. If a thermal fixing apparatus employing such a fixing belt is repeatedly used, the temperature of the members for supporting the heating member exceeds their limits in terms of thermal resistance, becoming thereby damaged, which has been a problem.

Thus, it has been conceived to use a metallic substance as the material for the substrate layer for a fixing belt, in order to increase the thermal conductivity of the fixing belt. However, when this concept was employed as the only means for solving the above described problem, it has not been successful; it was not able to sufficiently increase the startup speed of an image forming apparatus.

SUMMARY OF THE INVENTION

The present invention was made in consideration of the above described problem, and the primary object of the present invention is to provide an image heating apparatus capable of quickly starting up in spite of its employment of a fixing belt comprising an elastic layer.

According to an aspect of the present invention, there is provided an image heating apparatus comprising a heater; a rotatable member movable while being in contact with contact, said rotatable member including a metal layer and an elastic layer; a pressing member cooperative with said heater to form a nip for nipping and feeding a recording material; wherein said metal layer has a thickness which is not less than 10 $\mu$m and not more than 60 $\mu$m, and wherein u pressure per unit length with respect to a longitudinal direction of the nip is not less than 0.39N/mm and not more than 0.98N/mm.

According to another aspect of the present invention, there is provided an image heating apparatus comprising a heater: a rotatable member movable while being in contact with contact, said rotatable member including a metal layer and an elastic layer; a pressing member cooperative with said heater to form a nip for nipping and feeding a recording material; a temperature detecting element for detecting a temperature of said rotatable member; control means for controlling electric power supply to said heater so that temperature detected by said temperature detecting element is maintained at a target temperature.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS (1) General Structure of Apparatus

Figure 1:
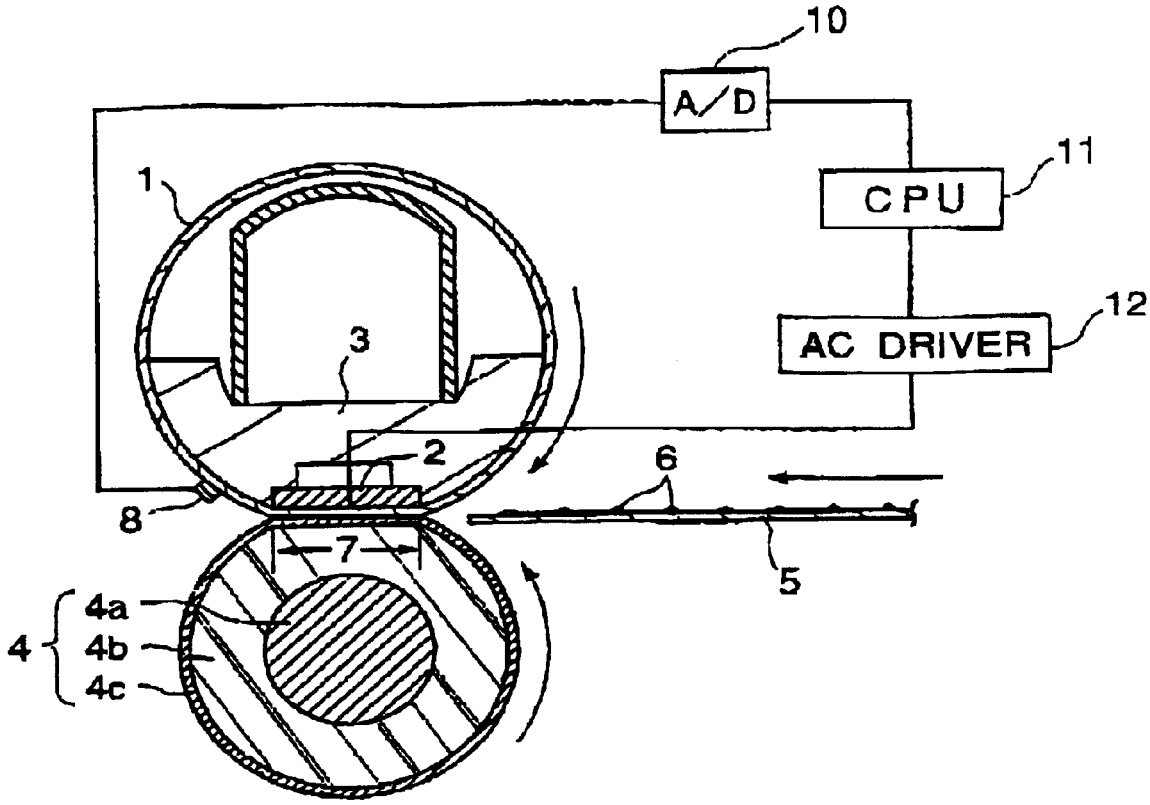
FIG. 1 is a schematic sectional view of one of the embodiments of a thermal fixing apparatus in accordance with the present invention.

FIG. 1 is a schematic sectional view of one the embodiments of a thermal fixing apparatus in accordance with the present invention, used as a fixing apparatus. In FIG. 1, a referential numeral 1 stands for an endless belt (rotational member) comprising a metallic substrate layer and an elastic layer, and a referential numeral 2 stands for a heating member (heater) comprising a substrate plate and a heat generating resistor formed on the substrate plate. A referential numeral 3 stands for a belt guiding member for supporting the heating member 2 as well as guiding the movement of the belt 1. The belt guiding member is molded of liquid polymer, phenol resin, PPS, PEEK, or the like which are heat resistant. The belt 1 is loosely fitted around the sub-assembly comprising the heating member 2 and supporting member 3. In other words, the heating member 2 and supporting member 3 are disposed within the loop of the belt 1. Further, the belt 1 is moved around the combination of the heating member 2 and supporting member 3, while sliding on the heating member 2 and supporting member 3. Therefore, the frictional resistance needs to be as small as possible between the belt 1 and heating member 2 and between the belt and supporting member 3. Thus, there is provided a small amount of heat resistant lubricant, such as heat resistant grease, between the belt 1 and heating member 2 and between the belt 1 and supporting member 3.

Designated by a referential numeral 4 is a pressure roller as a pressure applying member, which is pressed upon the heating member 2, with the interposition of the belt 1. The pressure roller 4 is rotationally driven by an unshown driving means, functioning also as a driving roller for driving the belt 1 The pressure roller 4 comprises: a metallic core 4*a* formed of aluminum or the like; a heat resistant elastic layer 4*b* molded of silicone rubber, fluorinated rubber, foamed silicone rubber, or the like, on the peripheral surface of the metallic core 4*a*; and a releasing layer 4*c* formed of fluorinated resin or the like, on the peripheral surface of the rubber layer 4*b*.

At least while an image is fixed, the belt 1 is rotationally moved in the clockwise direction by the counterclockwise rotation of the pressure roller 4, at a predetermined peripheral velocity, which is virtually the same as the velocity at which a recording medium 5, as the object to be heated, bearing an unfixed toner image 6, is conveyed. As it is rotated, it slides on the bottom surface of the heating member 2. The surface temperature of the belt 1 is detected by a temperature detection element 8, and the detected temperature is fed back to a temperature control circuit 11 through an A/D converter 10, in order to control an AC driver 12 to control the power supply to the heating member 2 so that the surface temperature of the belt 1 is kept at the predetermined level.

With the belt 1 being rotationally driven, the recording medium 5 is guided into the interface between the belt 1 and pressure roller 4, in a compressive nipping portion 7 formed by the heating member 2 and pressure roller 4. As a result, the recording medium 5 is conveyed through the compressing nipping portion 7, along with the belt 1, with the recording medium P kept pressed upon the outwardly facing surface of the belt 1. As the recording medium 5 is passed through the compressive nipping portion 7, the heat generated by the heating member 2 is given to the recording medium 5 through the belt 1, and also, pressure is applied to the recording medium P. As a result, the unfixed toner image 6 on the recording medium 5 is thermally welded to the recording medium 5. After the fixation of the unfixed toner image to the recording medium 5, that is, after the passing of the compressive nipping portion 7, the recording medium 5 is separated from the belt 1, and is discharged from the main assembly of the image forming apparatus.

The process for forming the unfixed toner image 6 on the recording medium 5 is not depicted in FIG. 1. The toner image 6 is formed in the image forming portion of the image forming apparatus, with the use of an electrophotographic process, an electrostatic recording process, a magnetic recording process, or the like. Further, the toner image 6 is directly or indirectly formed on the recording medium. When it is indirectly formed, it is first formed on a temporary image bearing member, and then, is transferred onto a permanent image bearing member, that is, the recording medium 5.

Next, each of the various structural components of the fixing apparatus will be described in detail.

(2) Belt 1

Figure 2:
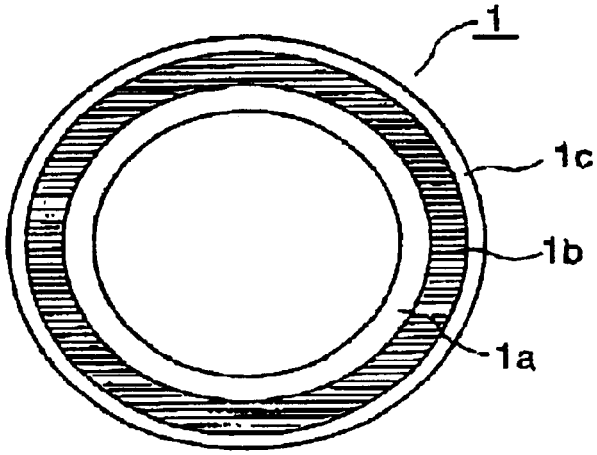
FIG. 2 is a schematic cross sectional view of the heating belt of the thermal fixing apparatus in FIG. 1, for showing the cross section thereof.

FIG. 2 is a schematic cross sectional view of the belt 1, for showing the laminar structure thereof. This embodiment of a fixing belt in accordance with the present invention is a multilayer endless belt comprising at least a metallic substrate layer 1*a* and an elastic layer 1*b*.

a) Metallic Substrate Layer 1*a*

As the material for the metallic substrate layer 1*a*, metals superior in thermal conductivity, for example, nickel, stainless steel, aluminum, etc., and alloys thereof, can be used. However, an alloy, the main component of which is nickel, is preferably used because of its advantage of being precisely formable.

If resinous substance such as polyimide (PI) or the like, that is, the conventional substrate layer material, which is lower in thermal conductivity than the metallic substances, is used as the material for the substrate layer material for the heating belt, which comprises an elastic layer, it is difficult for the heat generated by the heater to be transmitted to the object to be heated. With the employment of a metallic substance as the substrate layer material as it is in this embodiment, it is possible to increase the thermal conductivity of a fixing belt.

The metallic substrate layer 1*a* can he manufactured from such a material as nickel or the like, which is formed by electroforming. More specifically, a columnar matrix of stainless steel, copper, or the like is placed in electroforming solution, for example, nickel sulfamate, nickel sulfate, nickel acetate, etc., and a nickel layer with a predetermined thickness is formed on the peripheral surface of the matrix by electroplating. Then, the matrix is removed to obtain a thin metallic substrate for the fixing belt.

From the standpoint of the strength of the belt 1, the thickness of the metallic substrate layer 1*a* is desired to be no less than 10 $\mu$m. On the other hand, the greater the thickness of the substrate layer 1*a*, the greater the thermal capacity of the substrate layer 1*a*. Therefore, if the thickness of the metallic substrate layer 1*a* is no less than a certain value, it takes too much time to increase the surface temperature of the belt 1 to a proper level for reliable toner image fixation. Further, the thicker the metallic substrate layer 1*a*, the stiffer the belt 1, and the stiffer the belt 1, the more difficult it is to keep the belt 1 satisfactorily in contact with the heating member 2. Therefore, the metallic substrate layer 1*a* is desired to be no more than 60 $\mu$m in thickness. In other words, the thickness of the metallic substrate layer 1*a* is desired to no less than 10 $\mu$m and no more than 60 $\mu$m. Moreover, from the standpoint of the satisfactory contact between the belt 1 and heating member 2, the internal diameter of the metallic substrate layer 1*a* is desired to be no less than 15 mm.

The studies by the inventors of the present invention revealed that in order to quickly increase the surface temperature of the belt 1 to the proper temperature for toner image fixation after the starting of the power supply to the heating member 2, the thermal fixing apparatus had to be excellent in the heat transfer from the heating member 2 to the belt 1. For example, in order to reduce to no more than 30 seconds, the time it takes for the first recording medium to be outputted after the starting of the power supply to the heating member 2, no less than 7.5 KJ of heat must be generated within the first 15 seconds after the starting of the power supply to the heating member 2. Otherwise, it is difficult to make the surface temperature of the belt 1 reach the temperature range for proper toner image fixation. In other words, the studies by the inventors of the present invention revealed that in order to assure that a sufficient amount of heat is obtained in a short time for thermal fixation, not only must the belt 1 itself be excellent in thermal conductivity, but also, the state of contact between the heating member 2 and belt 1 must be as flawless as possible. Thus, in this embodiment, the substrate layer 1*a* is formed of a metallic substance, and also, its thickness is made to be no less than 10 μm and no more than 60 μm in order to afford the belt 1 flexibility sufficient to allow the belt 1 to be kept satisfactorily in contact with the heating member 1. Further, in order to render the belt 1 sufficiently flexible, the internal diameter of the metallic substrate layer 1*a* is desired to be no less than 15 mm.

b) Elastic Layer 1*b*

As the material for the elastic layer 1*b*, heat resistant elastomer, such as fluorinated rubber, silicone rubber, etc., is used. As for the method for forming the elastic layer 1*b*, a coating means, such as the spray coating, is used. More specifically, an uncured rubbery material is uniformly sprayed on the electroformed nickel substrate layer to a predetermined thickness with the variation of ±20 μm, and is made to bridge/harden with the use of a heating means such as an oven. The aforementioned rubbery substances may contain filler, such as silica, alumina, boron nitride, etc., which improves thermal conductivity.

The thickness of the elastic layer 1*b* is optional; it should be determined in consideration of the thermal conductivity and elasticity of the material.

However, in order to obtain a satisfactory degree of resolution without crushing a toner image, the thickness of the elastic layer 1*b* is preferred to be no less than 50 μm. If the thickness of the elastic layer 1*b* is greater than a certain value, it takes excessive time to raise the surface temperature of the belt 1. Therefore, it is desired to be no more than 500 μm, preferably, no less than 100 μm and no more than 300 μm.

c) Releasing Layer 1*c*

For the purpose of ensuring that toner particles are satisfactorily released from the surface of the belt 1, the outermost layer of the belt 1 is desired to be formed of silicone 1 rubber, or fluorinated resin such PFA, PTFE, FEP, etc., which has a releasing property. As for the method forming this outermost layer with the releasing property, that is, the releasing layer 1*c*, it is desired that the releasing layer 1*c* is formed by coating, or fitting over the elastic layer 1*b*, a piece of tube formed of one of the aforementioned materials.

For the purpose of preventing the inward surface of the metallic substrate layer 1*a* from being deteriorated as it is rubbed by the heating member 2 and supporting member 3, the inward surface of the metallic layer 1*a* may be covered with a heat resistant resin such as polyimide.

Also for the purpose of improving the adhesion between the metallic substrate layer 1*a* and elastic layer 1*b* and between the elastic layer 1*b* and releasing layer 1*c*, a layer other than the aforementioned ones may be present between the layers 1*a* and 1*b* and between the layers 1*b* and 1*c*.

(3) Heating Member 2

Figure 3:
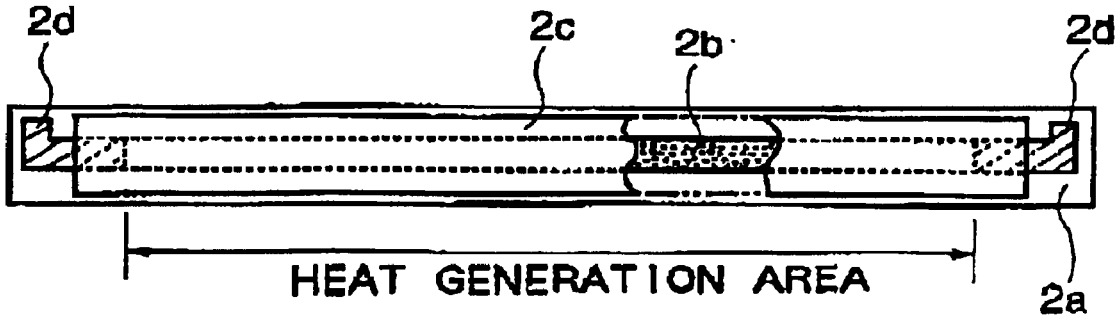
FIG. 3 is a partially broken plan view of the heating member of the thermal fixing apparatus in FIG. 1.

FIG. 3 is a partially broken schematic plan of the heating member 2. This heating member 2 comprises a substrate 2*a* and a heat generating layer 2*b*. The substrate 2*a* is formed of a highly insulative ceramic, such as alumina, aluminum nitride, silicon carbide, etc., and is in the form of a piece of thin plate. The heat generating layer 2*b* is formed on the top or bottom surface of the substrate 2*a*, being extended in the lengthwise direction of the substrate 2*a* (direction perpendicular to direction in which object to be heated is moved), and is formed of such a substance as Ag/Pd (silver palladium alloy), $RuO_2$, $Ta_2N$, etc., that generates heat as electric current is flowed through it, using screen printing or the like method. The heat generating layer 2*b* is in the form of a piece of thin wire or a piece of narrow strip, which is approximately 10 μm in thickness and approximately 1–5 mm in width. In order to enable the heating member 2 to withstand the friction from the belt 1, the heating member 2 is provided with a thin insulative protective layer 2*c*, as a surface layer, formed of glass or the like. Power is supplied to the heat generating layer 2*b* from an unshown power supplying means through a pair of electrodes 2*d* located at the lengthwise ends of the heat generating member 2, one for one As described above, in the case of this embodiment of the present invention, the belt 1 (rotational member) comprises the metallic layer 1*a* and elastic layer 1*b*, and the power supply to the heat generating layer 2*b* is controlled by the power controlling means 11 so that the temperature detected by the temperature detection element 8 for detecting the temperature of the fixing belt 1 remains at a target level (fixing temperature).

(4) Pressure Roller 4

The pressure roller 4 comprises: a metallic core 4*a* formed of iron, aluminum, or the like; an elastic layer 4*b* which covers the peripheral surface of the metallic core 4*a*, being formed of a heat resistant rubber, such as silicone rubber, fluorinated rubber, foamed silicone rubber, etc.; and a releasing layer 4*c* which covers the elastic layer 4*b*, and is formed of PFA, PTFE, FEP, or the like The pressure roller 4 is approximately 20 mm in diameter, and is kept pressed by an unshown pressing means, by the lengthwise ends, in the direction of the belt 1, so that the compressive nipping portion 7 necessary for thermal fixation is formed between the belt 1 and pressure roller 4. If the amount of the pressure applied to the pressure roller 4 is smaller than a certain value, heat cannot be given to the toner by a sufficient amount, and also, the belt 1 cannot be kept satisfactorily in contact with the heating member 2. Therefore, the amount of the pressure applied to the pressure roller 4 is desired to be such that a pressure of no less than 0.39 N/mm, in terms of the lengthwise direction of the pressure roller 4, is generated between the pressure roller 4 and belt 1. The greater the amount of the pressure applied to the pressure roller 4, the greater the amounts of the pressures that apply between the belt 1 and heating member 2 and between the belt 1 and supporting member 3, and therefore, the greater the frictional resistance generated as the belt 1 is rotationally driven. The greater the frictional resistance, the greater the amount of the torque necessary to rotate the pressure roller 4, and therefore, the greater the stress to which the belt 1 is subjected. The greater the stress to which the belt 1 is subjected, the greater the fatigue of the metallic substrate layer 1*a*, and therefore, the less durable the belt 1. Therefore, the amount of the pressure applied to the pressure roller 4 is desired to be such that the amount of the pressure generated between the belt 1 and pressure roller 4 becomes no more than 0.98 N/mm, in terms of the lengthwise direction of the pressure roller 4.

The pressure applied to the pressure roller 4 is provided by disposing one for one a pair of springs (unshown) with an optional spring constant, at both the lengthwise ends of the pressure roller 4 or supporting member 3, in such a manner that the lengthwise ends of the pressure roller 4 or supporting member 3 are pressed by the pair of springs. The amount of the pressure is controlled by adjusting the spring length.

Embodiment

Embodiment 1

The belt 1 for a thermal fixing apparatus, which was 24 mm in internal diameter, was formed using the following method: A piece of metallic plate (30 μm in thickness), the main component of which was nickel, was prepared as the substrate, and silicone rubber was sprayed onto the surface of the substrate to form an elastic layer (200 μm in thickness); and, fluorinated resin was sprayed onto the exposed surface of the elastic layer to form a releasing layer (20 μm in thickness), as the outermost layer. This belt 1 was employed as the heating belt for an external fixing apparatus, in which the amount of the pressure generated between the pressure roller 4 and belt 1 per unit length in terms of the lengthwise direction of the pressure roller 4 was 0.49 N/mm, and the amount of the power supply to the heating member 2 was 550 W. Then, this belt 1 was evaluated by the following method.

Evaluation Method

Recording mediums having a linear pattern (color layering) formed with the use of color toners optimally fixable at a process speed of 120 mm/sec and at a temperature of 180° C. were prepared. The control portion of the fixing device was set to control the power supply to the heating member 2 so that the detected surface temperature of the belt 1 remained at 180° C. Since the belt 1 was rotated by the rotation of the pressure roller 4, the rotational velocity of the pressure roller 4 was controlled so that the rotational velocity of the belt 1 became 120 mm/sec.

The above described fixing device was tested in the following manner. First, the power supply to the heating member 2 was started at the same time as the rotation of the belt 1 was started. Then, the amount of the heat generated during the first 15 seconds after the starting of the power supply to the heating member 2 was measured. When the belt temperature reached 180° C. 15 seconds after the starting of the power supply to the heating member 2, a recording medium bearing an unfixed toner image was passed through the fixing device, whereas when it took more than 15 seconds for the belt surface temperature to reach 180° C., a recording medium bearing an unfixed toner image was passed through the fixing device after the belt surface temperature reached 180° C. Then, the obtained permanent copies were examined for the toner image fixation. Incidentally, the surface temperature of the belt 1 was measured by placing a thermocouple in contact with the surface of the belt 1.

The results of the evaluation are given in Table 1. It is evident from the results that when the belt 1 was employed as the heating belt and the compressive pressure in the nipping portion was set to 0.49 N/mm, the heating member 1 generated 7.6 KJ of heat in 15 seconds after the starting of the power supply to the heating member 1, and the belt surface temperature reached 180° C. at which the satisfactory. Toner image fixation was possible, in 9.5 seconds after the starting or the power supply to the heating member 1. Further, the fixed toner images were virtually identical in resolution to the unfixed images, proving the excellence of this belt 1 in terms of the fixing performance.

Image Evaluation Symbols

G: fixed toner image were virtually identical in resolution to unfixed toner images; NG: fixed toner images had been crushed, and were substantially lower in resolution than unfixed toner images.

Embodiment 2

A belt 2 for a thermal fixing apparatus was prepared, which was virtually the same as the belt 1, except for the thickness, which was 400 μm for the belt 2. The belt 2 was evaluated in the same manner as the belt 1. The results of the evaluation are given in Table 1. It is evident from the results that the belt 2, or the second embodiment of the present invention, was capable of both preventing the temperature of the back surface of the heater from excessively rising, and quickly starting up on demand; unfixed toner images were fixed, with their resolutions kept at a satisfactory level, and the startup time was satisfactorily short.

Embodiment 3

A belt 3 for a thermal fixing apparatus was prepared, which was virtually the same as the belt 1, except for the thickness, which was 50 μm for the belt 3. The belt 3 was evaluated in the same manner as the belt 1. The results of the evaluation arc given in Table 1. It is evident from the results that the belt 3, or the third embodiment of the present invention, was capable of both preventing the temperature of the back surface of the heater from excessively rising, and quickly starting up on demand; unfixed toner images were fixed, with their resolutions kept at a satisfactory leave, and the startup time was satisfactorily short. Further, the belt 3 was satisfactorily durable.

Embodiment 4

The belt 1, that is, the first embodiment of a heating belt in accordance with the present invention, was employed as the heating belt for an external fixing apparatus. Further, the pressure applied to the pressure roller 4 was set so that the compressive pressure in the nipping portion per unit length in terms of the lengthwise direction of the pressure roller 4 became 0.74 N/mm. Otherwise, the external fixing apparatus was identical to the first embodiment. Then, the fixing apparatus was evaluated in the same manner as the first embodiment. The results of the evaluation are given in Table 1. It is evident from the results that the fourth embodiment of the present invention, was capable of both preventing the back surface of the heater from excessively rising, and quickly starting up on demand; unfixed toner images were fixed, with their resolutions kept at a satisfactory level, and the startup time was satisfactorily short. Further, the amount of the torque necessary to rotate the pressure roller 4 was below the level above which problems occurred.

COMPARATIVE EXAMPLE 1

A heating belt 4 for a thermal fixing apparatus, which is virtually identical to the belt 1 in the first embodiment, except for the absence of the elastic layer, was prepared. This belt 4 was evaluated in the same manner as the belt 1. The results of the evaluation are given in Table 1. As is evident from the results that with the employment of this belt 4, the resolution dropped as unfixed toner images were passed through the thermal fixing apparatus;: they were not satisfactorily fixed.

COMPARATIVE EXAMPLE 2

A heating belt 5 for a thermal fixing apparatus, which was virtually identical to the heating belt 1 in the third embodiment, except that the substrate layer of this belt 4 was formed of polyimide resin (P1). The thermal fixing apparatus employing this belt 4 was evaluated in the same manner as the first embodiment. The results of the evaluation are given in Table 1. As is evident from the results that the heating apparatus was satisfactory in both the increase in the belt surface temperature and the image fixation performance. However, after several repetitions of the image evaluation tests, the supporting member 3 was damaged (melted) by the heat from the heating member 1.

TABLE 1

| | Belt | Base lyr mat. & thck (μm) | Elast. lyr thck (μm) | Innr dia. of belt (mm) | P per unit lngth (N/mm) | Pwr to htr (W) | Time to 180° C. | Heat amnt after 15 sec | Image qualty | Rmks |
|---|---|---|---|---|---|---|---|---|---|---|
| Emb. 1 | 1 | Ni30 | 200 | 24 | 0.49 | 550 | 9.5 | 7.6 | G | |
| Emb. 2 | 2 | N130 | 400 | 24 | 0.49 | 550 | 14.1 | 11.8 | G | |
| Emb. 3 | 3 | Ni50 | 200 | 24 | 0.49 | 550 | 11.6 | 10.2 | G | |
| Emb. 4 | 1 | Ni30 | 200 | 24 | 0.74 | 550 | 9.0 | 7.4 | G | |
| Comp 1 | 4 | Ni30 | Non | 24 | 0.49 | 550 | 13.9 | 8.1 | NG | |
| Comp 2 | 5 | PI50 | 200 | 24 | 0.49 | 550 | 14.6 | 8.1 | G | *1 |

*1: the supporting member is melted or damaged in several times tests.

While the invention has been described with reference to the structures disclosed herein, it is not confined to the details set forth and this application is intended to cover such modifications or changes as may come within the purpose of the improvements or the scope of the following claims

What is claimed is:

1. An image heating apparatus comprising:

a heater;

a flexible rotatable member movable while being in contact with said heater, said rotatable member including a metal layer and an elastic layer; and a pressing member cooperative with said heater to form a nip with said rotatable member therebetween, said nip for nipping and feeding a recording material;

wherein said metal layer has a thickness which is not less than 10 μm and not more than 60 μm, and wherein a pressure per unit length with respect to a longitudinal direction of the nip is not less than 0.39N/mm and not more than 0.98N/mm.

2. An apparatus according to claim 1, wherein the thickness of said elastic layer is not less than 50 μm and not more than 500 μm.

3. An apparatus according to claim 2, wherein the thickness of said elastic layer is not less than 100 μm and not more than 300 μm.

4. An apparatus according to claim 1, wherein an inner diameter of said rotatable member is not less than 15 mm.

5. An apparatus according to claim 1, wherein said metal layer mainly comprises nickel.

6. An apparatus according to claim 1, wherein said heater generates a heat quantity which is not less than 7.5 KJ within 15 sec from start of electric power supply.

7. An apparatus according to claim 1, further comprising a temperature detecting element for detecting a temperature of said rotatable member, and control means for controlling electric power supply to said heater so that the temperature detected by said temperature detecting element is maintained at a target temperature.

8. An image heating apparatus comprising:

a heater;

a rotatable member movable while being in contact with said heater, said rotatable member including a metal layer and an elastic layer;

a pressing member cooperative with said heater to form a nip with said rotatable member therebetween, said nip for nipping and feeding a recording material;

a temperature detecting element for detecting a temperature of said rotatable member; and control means for controlling electric power supply to said heater so that temperature detected by said temperature detecting element is maintained at a target temperature.

* * * * *

UNITED STATES PATENT AND TRADEMARK OFFICE

CERTIFICATE OF CORRECTION

PATENT NO. : 6,862,424 B2
DATED : March 1, 2005
INVENTOR(S) : Katsuhisa Matsunaka et al.

It is certified that error appears in the above-identified patent and that said Letters Patent is hereby corrected as shown below:

Title page,
Item [57], ABSTRACT,
Line 3, “heater:” should read -- heater; --.
Line 6, “layer:” should read -- layer; --.

Column 2,
Line 45, “u” should read -- a --.
Line 50, “heater:” should read -- heater; --.

Column 3,
Line 9, “one” should read -- one of --.
Line 37, “belt 1” should read -- belt 1. --.

Column 7,
Line 55, “tory. Toner” should read -- tory toner --.

Column 8,
Linr 15, “arc” should read -- are --.
Line 20, “leave,” should read -- level, --.
Line 51, “apparatus;:” should read -- apparatus; --.

Column 9,
Line 21, “claims” should read -- claims. --.

Signed and Sealed this

Twelfth Day of July, 2005

JON W. DUDAS
*Director of the United States Patent and Trademark Office*